US005626499A

United States Patent [19]

Yagi et al.

[11] Patent Number: 5,626,499

[45] Date of Patent: May 6, 1997

[54] CONNECTOR

[75] Inventors: Sakai Yagi; Masanori Tsuji; Keishi Jinno, all of Shizuoka, Japan

[73] Assignee: Yazaki Corporation, Tokyo, Japan

[21] Appl. No.: 385,120

[22] Filed: Feb. 7, 1995

[30] Foreign Application Priority Data

Feb. 10, 1994 [JP] Japan ..... 6-016625

[51] Int. Cl.[6] ..... H01R 13/514

[52] U.S. Cl. ..... 439/752.5; 439/595

[58] Field of Search ..... 439/595–598, 439/603, 444, 733.1, 747, 752.5

[56] References Cited

U.S. PATENT DOCUMENTS 3,980,385 9/1976 Hirokawa et al. ..... 439/752.5 X
4,374,604 2/1983 Hemmer et al. ..... 439/752.5 X
4,963,102 10/1990 Gettig et al. ..... 439/752.5
5,190,477 3/1993 Akeda ..... 439/752.5 X
5,326,287 7/1994 Hamakita et al. ..... 439/595 X

*Primary Examiner*—Khiem Nguyen
*Attorney, Agent, or Firm*—Sughrue, Mion, Zinn, Macpeak & Seas

[57] ABSTRACT

A connector for preventing a front end portion of a connection terminal, inserted into a terminal insertion hole, from falling into an erroneous insertion prevention groove. The groove for receiving the erroneous insertion prevention projection formed on the connection terminal is formed at each terminal insertion hole formed in a connector housing for receiving the connection terminal. The groove is formed at a position offset from a front end portion of the connection terminal, or the groove is smaller in width than this front end portion.

5 Claims, 4 Drawing Sheets

CONNECTOR

BACKGROUND OF THE INVENTION

1. Field of the Invention

This invention relates to a connector having connection terminals attached thereto for achieving an electrical connection in electrical wiring or the like, and more particularly to a connector of the type in which a groove for receiving an erroneous insertion prevention projection formed on a connection terminal to be inserted into a terminal insertion hole in a connector housing is formed at the terminal insertion hole.

2. Related Art

Various types of connectors have heretofore been used for connecting electrical wires together. In one of these connectors, an erroneous insertion prevention projection is formed on a connection terminal for preventing an erroneous insertion thereof when mounting the connection terminal within a connector housing, while a groove for receiving the erroneous insertion prevention projection is formed at a terminal insertion hole formed in the connector housing for receiving the connection terminal. A proper fitting condition is achieved when the erroneous insertion prevention projection is fitted in the groove.

FIG. 7 shows a basic construction of such a conventional connector.

The connector shown in this figure is used, for example, for achieving an electrical connection of a wire harness in an automobile or the like. A connection terminal 1, formed by blanking and bending a metal sheet has a tongue-like contact piece portion 2 at its distal end, and also has at its proximal end portion a clamping portion 3 for holding an insulative covering of a wire, as well as a clamping portion 4 for holding a conductor of the wire. This connection terminal also has an erroneous insertion prevention projection 5 formed by stamping at a lower side of an intermediate portion thereof, and further has a lance engagement portion 6 formed at an upper side of the intermediate portion.

A connector housing 9, having terminal insertion holes 8 for respectively receiving the connection terminals 1, is molded of an insulative synthetic resin. Referring to a basic construction of this housing, a groove 10 for receiving the erroneous insertion prevention projection 5, as well as a lance 11 which engages the lance engagement portion 6 to prevent withdrawal of the connection terminal 1 when this terminal is inserted into a predetermined position in the terminal insertion hole 8, are provided in the terminal insertion hole 8.

In the conventional connector, the groove 10 is disposed centrally of the width of each terminal insertion hole 8 as at 12 in FIG. 8.

In accordance with such arrangement of the groove 10, the erroneous insertion prevention projection 5, formed on the bottom of the connection terminal 1, is also disposed centrally of the width thereof as at 14 in FIGS. 9 and 10.

With this construction, the connection terminal 1 of this construction can be properly inserted into the terminal insertion hole 8 as shown in FIG. 11, so that the connection terminal 1 is disposed in a so-called normally-mounted condition in which the lance 11 completely retains the connection terminal 1 against withdrawal.

The contact piece portion 2 of the connection terminal 1 is adapted to be fitted into a female connection terminal mounted within a mating connector housing, and in order to facilitate the fitting, the front end portion of this contact piece portion is usually reduced in dimension in the directions of the thickness and width thereof. In the conventional construction, if the groove 10 has such a widthwise dimension W2 (see FIG. 8) as to receive the erroneous insertion prevention projection 5, this groove can perform its function, and the housing can be molded more easily if this widthwise dimension is relatively large. For this reason, this widthwise dimension has been larger than a widthwise dimension W1 (see FIG. 9) of the front end portion of the contact piece portion 2.

Therefore, if the connection terminal 1 is inserted into the terminal insertion hole 8 in such a manner that the front end of the contact piece portion 2 is generally directed toward the groove 10, the front end of the contact piece portion 2 falls in the groove 10, and engages the inner end of the groove 10. In some cases, this has prevented a smooth insertion of the connection terminal.

Recently, for labor saving purposes, the assembling of such a connector has now been carried out by automation, and the insertion of the connection terminal 1 into the terminal insertion hole 8 has been effected by an automation machine. In the automation machine, if there occurs an insertion error as shown in FIG. 12, the direction of insertion of the connection terminal 1 can not be easily corrected, as compared with a manual operation. Therefore, the operation must be finished in such an abnormal condition, and then the insertion operation must be carried out again to deal with this situation.

SUMMARY OF THE INVENTION

An object of this invention is to overcome the above problems, and more specifically to provide a connector in which a front end of a connection terminal inserted into a terminal insertion hole will not fall in an erroneous insertion prevention groove, and hence will not be caught halfway during the inserting operation, and even in the assembly of the connector by an automation machine, the connection terminal can be inserted into the terminal insertion hole smoothly and positively, thus improving the efficiency of the assembling operation by automation.

The above object of the present invention has been achieved by a connector wherein a groove for receiving an erroneous insertion prevention projection formed on a connection terminal is formed at each terminal insertion hole formed in a connector housing for receiving the connection terminal; characterized in that the erroneous insertion prevention projection is offset widthwise from a widthwise center position of a front end portion of the connection terminal at one side surface of the connection terminal where the projection is formed; and when the erroneous insertion prevention projection is fitted in the groove, opposite side edges of the groove are offset toward one side from a position disposed in registry with the front end portion of the connection terminal, or at least one of the opposite side edges is disposed inwardly of a position disposed in registry with the width of the front end portion.

The above object of the invention has also been achieved by a connector wherein a groove for receiving an erroneous insertion prevention projection formed on a connection terminal is formed at each terminal insertion hole formed in a connector housing for receiving the connection terminal; characterized in that a width of the groove is smaller than a width of that side surface of a front end portion of the connection terminal on which the projection is formed.

In the above construction of the present invention, even if the front end of the connection terminal is directed downwardly toward the erroneous insertion prevention groove, provided at the terminal insertion hole, during the insertion of the connection terminal into the terminal insertion hole in the connector housing, part of the front end portion of the connection terminal contacts the bottom surface in which the groove is formed, thereby positively preventing the front end portion of the connection terminal from falling in the groove.

DESCRIPTION OF THE PREFERRED EMBODIMENTS

Figure 1:
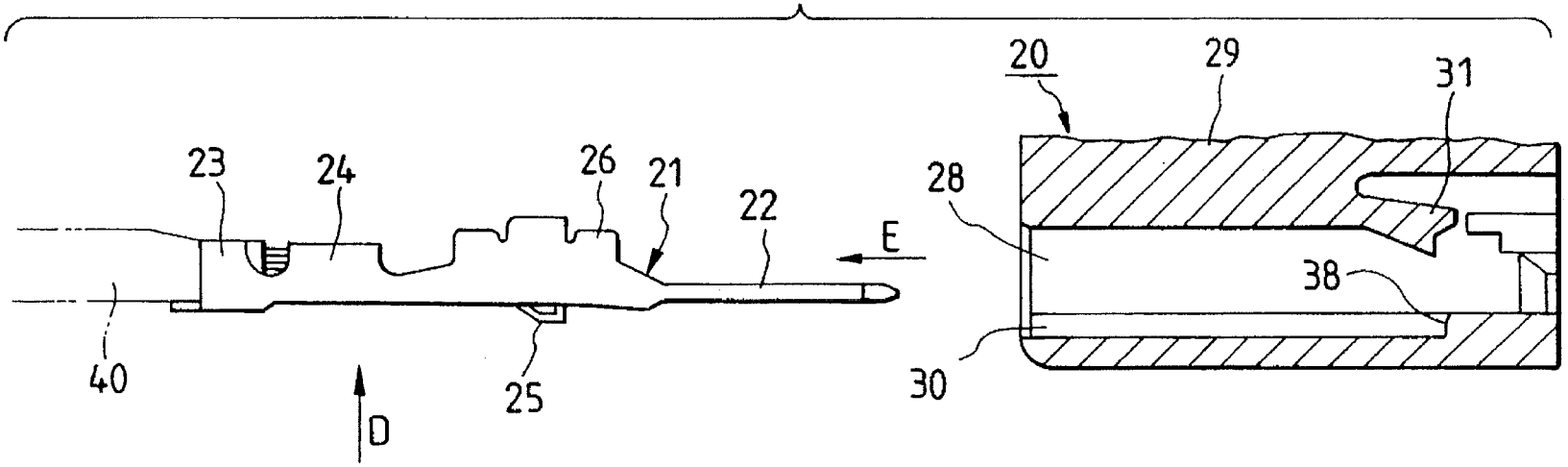
FIG. 1 is a partly cross-sectional, schematic side-elevational view of one preferred embodiment of the present invention.

FIG. 1 shows one preferred embodiment of a connector of the present invention.

The connector 20 shown in FIG. 1 is used for connecting a wire harness in an automobile or the like. A connection terminal 21, formed by blanking and bending a metal sheet, has a tongue-like contact piece portion 22 at its distal end, and also has at its proximal end portion a clamping portion 23 for holding an insulative covering of a wire 40, as well as a clamping portion 24 for holding a conductor of the wire. This connection terminal also has an erroneous insertion prevention projection 25 formed by stamping at a lower side of an intermediate portion thereof, and further has a lance engagement portion 26 formed at an upper side of the intermediate portion.

The contact piece portion 22 of the connection terminal 21 is adapted to be fitted into a female connection terminal mounted within a mating connector housing, and in order to facilitate the fitting, the front end portion of the contact piece portion 22 is usually reduced in dimension in the directions of the thickness and width thereof.

A connector housing 29, having terminal insertion holes 28 for respectively receiving the connection terminals 21, is molded of an insulative synthetic resin. A groove 30 for receiving the erroneous insertion prevention projection 25 is formed in a bottom surface 35 of the terminal insertion hole 28, and a lance 31, which engages the lance engagement portion 26 to prevent withdrawal of the connection terminal 21 when this terminal is inserted into a predetermined position in the terminal insertion hole 28, is provided at the terminal insertion hole 28.

Figure 3:
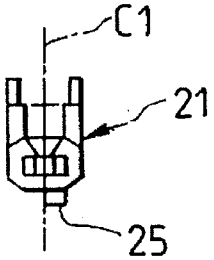
FIG. 3 is a view of the connection terminal as seen in a direction of arrow E of FIG. 1.
Figure 2:
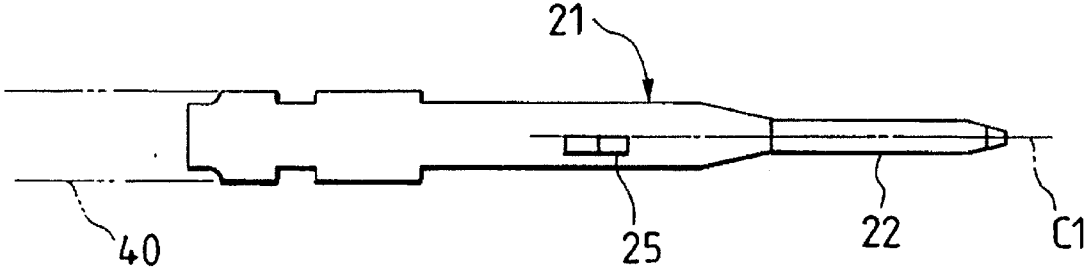
FIG. 2 is a view of a connection terminal as seen in a direction of arrow D of FIG. 1.
Figure 4:
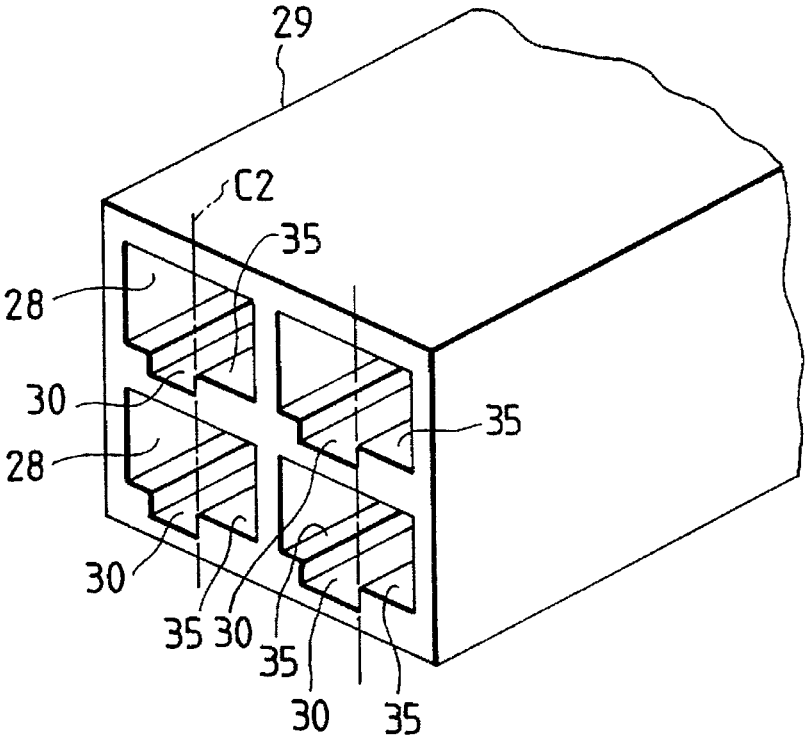
FIG. 4 is a perspective view of an important portion of a connector housing of FIG. 1.

In this embodiment, the position of formation of the erroneous insertion prevention projection 25 is offset widthwise a suitable distance from a widthwise center position C1 of the front end portion of the connection terminal 21, as shown in FIGS. 2 and 3. In accordance with this arrangement, the position of the groove 30 is also offset from a widthwise center position C2 of the terminal insertion hole 28, as shown in FIG. 4.

Figure 5:
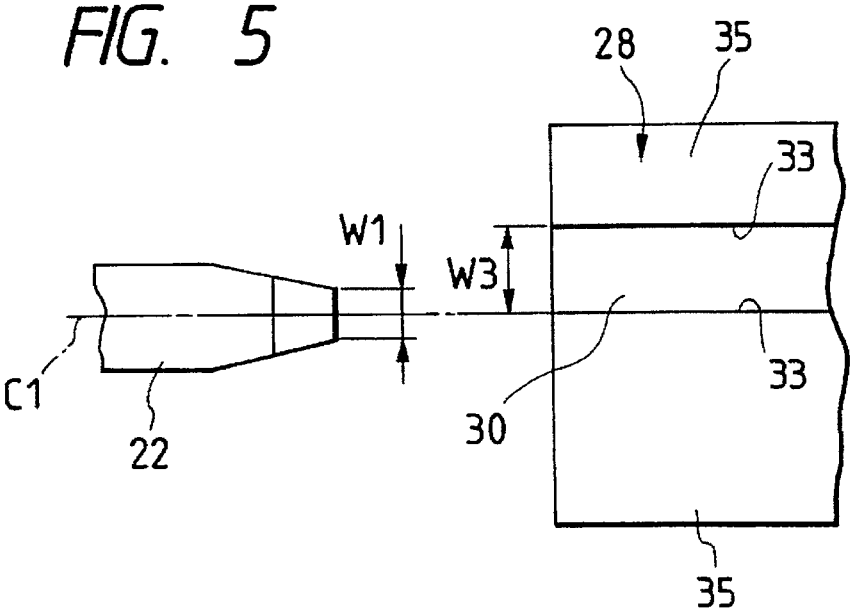
FIG. 5 is a schematic plan view explanatory of the positional relation between an erroneous insertion prevention groove and a front end portion of the connection terminal in the embodiment of FIG. 1.

As a result, when the connection terminal 21 is inserted into the terminal insertion hole 28, so that the erroneous insertion prevention projection 25 is fitted in the groove 30, one side edge 33 of the groove 30 is disposed inwardly of the width W1 of the front end portion of the contact piece portion 22 of the connection terminal 21 inserted in the terminal insertion hole 28 (see FIG. 5).

In this embodiment, the width W3 (see FIG. 5) of the groove 30 is larger than the width W1 of the front end portion of the contact piece portion 22, as in the conventional construction.

With this construction, even if there is exerted a force causing the front end of the connection terminal 21 to fall toward the erroneous insertion prevention groove 30 provided at the terminal insertion hole 28 during the insertion of the connection terminal 21 into the terminal insertion hole 28 in the connector housing 29, part of the front end of the connection terminal 21 contacts the bottom surface 35 immediately adjacent to the side edge 33 of the groove 30, thereby preventing the front end portion of the connection terminal 21 from falling in the groove 30.

Figure 6:
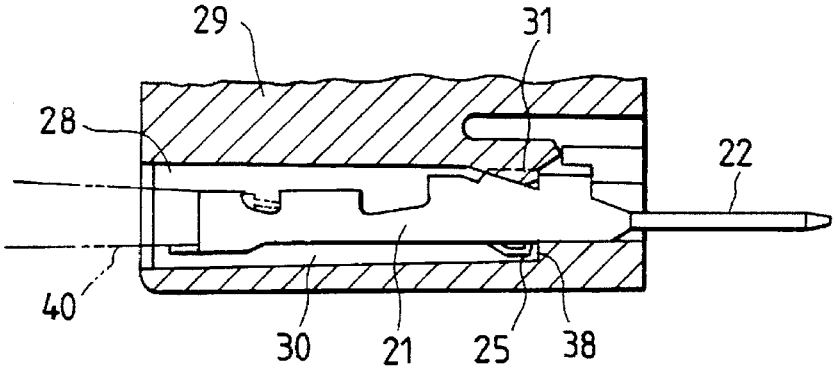
FIG. 6 is a view showing a completely-assembled condition of the connector of FIG. 1.
Figure 7:
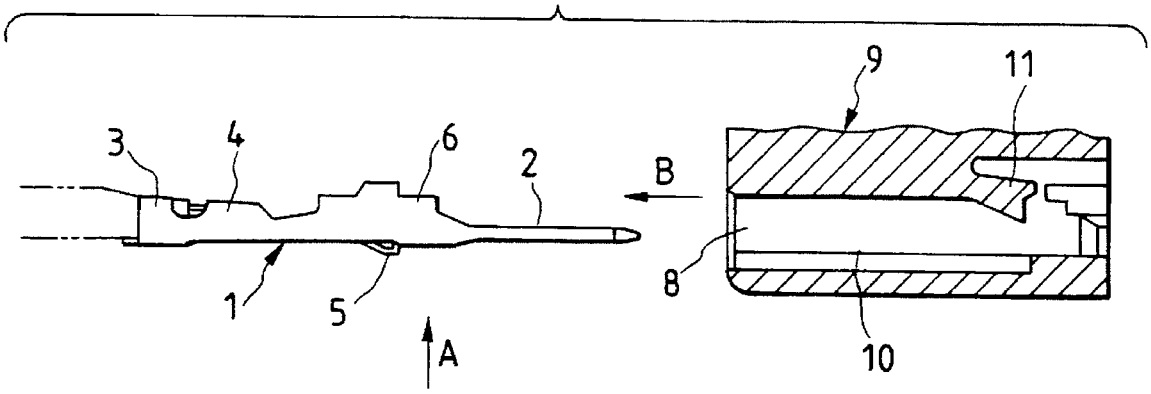
FIG. 7 PRIOR ART
FIG. 7 is a side-elevational view of a conventional connector.
Figure 8:
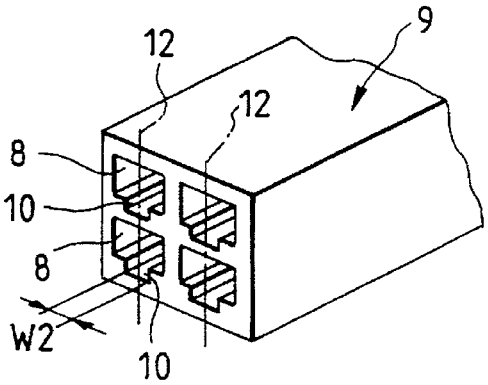
FIG. 8 PRIOR ART
FIG. 8 is a perspective view of a connector housing of the connector of FIG. 7.
Figure 9:
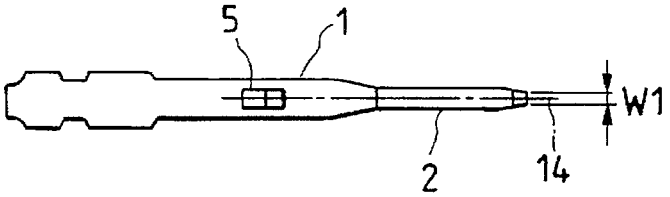
FIG. 9 PRIOR ART
FIG. 9 is a view of a connection terminal as seen in a direction of arrow A of FIG. 7.
Figure 10:
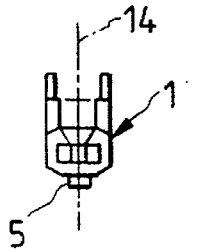
FIG. 10 PRIOR ART
FIG. 10 is a view of the connection terminal as seen in a direction of arrow B of FIG. 7.
Figure 11:
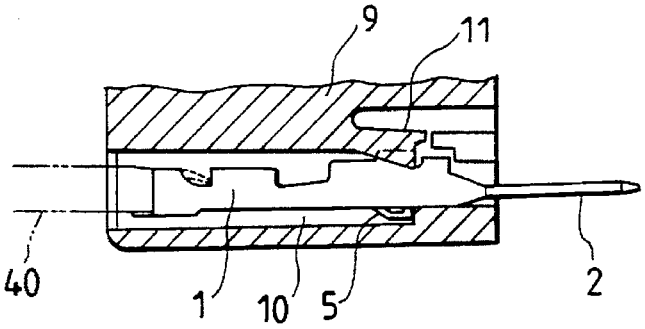
FIG. 11 PRIOR ART
FIG. 11 is a view showing a completely-assembled condition of the connector of FIG. 7.
Figure 12:
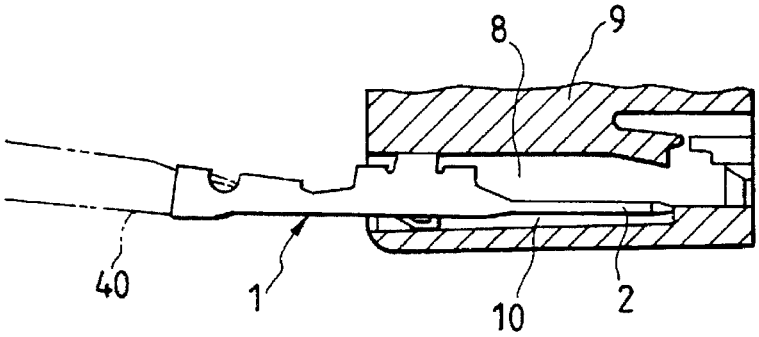
FIG. 12 PRIOR ART
FIG. 12 is a view explanatory of a problem with the connector of FIG. 7.

Thus, the front end portion of the connection terminal 21 inserted into the terminal insertion hole 28 will not fall in the erroneous insertion prevention groove 30, and hence this front end portion will not be caught by an inner end 38 of the groove 30 halfway during the inserting operation. Therefore, for example, even in the assembling of the connector by an automation machine, the connection terminal 21 can be smoothly and positively inserted into the terminal insertion hole 28 in the connector housing 29, and is held in a normally-mounted condition (FIG. 6) in which the lance 31 retains the connection terminal 21 against withdrawal.

The connection terminals 21 can be thus associated with the connector housing 29 quite smoothly, and therefore the efficiency of the assembling operation by automation or others can be improved.

In the present invention, although the side edge 33 of the groove 30 is disposed inwardly of the width W1 of the front end portion of the connection terminal 21, the two side edges 33 may be offset in the same direction from the front end portion of the connection terminal 21, depending on the width of the front end portion of the connection terminal 21, the width of that portion at which the erroneous insertion prevention projection 25 is formed, and the position of formation of the projection 25 and so on, and the invention is not limited to the above embodiment.

In the above embodiment, the position of formation of the erroneous insertion prevention projection 25 is offset from the widthwise center position C1 of the connection terminal 21, and in accordance with this, the position of formation of the groove 30 is also offset from the widthwise center position C2 of the terminal insertion hole 28, and with this construction at least one of the opposite side edges of the groove 30 is disposed inwardly of the width W1 of the front end portion of the connection terminal 21. However, in the present invention, for example, the erroneous insertion prevention projection 25 of the connection terminal 21 may be smaller than the width W1 of the front end portion of the connection terminal 21, in which case the width of the groove 30 is smaller than the width W1 of the front end portion of the connection terminal 21, so that one or both of the opposite side edges of the groove 30 are disposed inwardly of the width W1 of the front end portion of the connection terminal 21.

In this construction, also, the front end portion of the connection terminal 21 is prevented from falling into the groove 30 during the insertion of the connection terminal 21 into the terminal insertion hole 28, as in the above embodiment.

Where the erroneous insertion prevention projection 25 of the connection terminal 21 is smaller than the width W1 of the front end portion of the connection terminal 21, and in accordance with this, the width of the groove 30 is smaller than the width W1 of the front end portion of the connection terminal 21, the position of formation of the erroneous insertion prevention projection 25 and the position of formation of the groove 30 may not be offset from the center position C1 of the connection terminal 21 and the center position C2 of the terminal insertion hole 28, respectively.

In the above embodiment, the erroneous insertion prevention projection 25 is formed on the bottom surface of the connection terminal 21, but even if such an erroneous insertion prevention projection is formed on the side surface of the connection terminal, it can achieve its function. In this case, a similar construction can be suitably adopted at the side surface having the erroneous insertion prevention projection formed thereon, in which case the thickness of the front end portion of the connection terminal corresponds to the width of the front end portion in the above embodiment.

As described above, in the connector of the present invention, even if the front end of the connection terminal is directed downwardly toward the erroneous insertion prevention groove, provided at the terminal insertion hole, during the insertion of the connection terminal into the terminal insertion hole in the connector housing, part of the front end portion of the connection terminal contacts the bottom surface immediately adjacent to the upper edge of the groove, thereby positively preventing the front end portion of the connection terminal from falling in the groove.

Thus, the front end portion of the connection terminal inserted into the terminal insertion hole will not fall in the erroneous insertion prevention hole, and hence will not be caught halfway during the inserting operation, and even in the assembly of the connector by an automation machine, the connection terminal can be smoothly and positively mounted in the terminal insertion hole in the connector housing, and therefore the efficiency of the assembling operation by automation or others can be improved.

What is claimed is:

1. A connector comprising:

a connector housing having a terminal insertion hole for receiving a connection terminal; and a groove formed at the terminal insertion hole for receiving an erroneous insertion prevention projection of the connection terminal, and for preventing a front end portion of the connection terminal from falling into said groove, said groove having a width that is larger than a width of the front end portion of said connection terminal, wherein when the erroneous insertion prevention projection is fitted in the groove, opposite side edges of the groove are offset in the same direction from the front end portion of the connection terminal.

2. A connector as claimed in claim 1, wherein the erroneous insertion prevention projection is formed on one side surface of the connection terminal, and the erroneous insertion prevention projection is offset widthwise from a widthwise center position of the front end portion of the connection terminal.

3. A connector comprising:

a connector housing having a terminal insertion hole for receiving a connection terminal; and a groove formed at the terminal insertion hole for receiving an erroneous insertion prevention projection of the connection terminal and for preventing a front end portion of the connection terminal from falling into said groove, said groove having a width that is larger than a width of the front end portion of said connection terminal, wherein when the erroneous insertion prevention projection is fitted in the groove, at least one of opposite side edges of the groove is disposed inwardly of a width of the front end portion of the connection terminal.

4. A connector as claimed in claim 3, wherein the erroneous insertion prevention projection is formed on one side surface of the connection terminal, and the erroneous insertion prevention projection is offset widthwise from a widthwise center position of the front end portion of the connection terminal.

5. A connector comprising:

a connector housing having a terminal insertion hole for receiving a connection terminal; and a groove formed at the terminal insertion hole for receiving an erroneous insertion prevention projection of the connection terminal and for preventing a front end portion of the connection terminal from falling into said groove, wherein a width of the groove is smaller than a width of a front end portion of the connection terminal.

* * * * *